US011047126B1

(12) United States Patent
Whiteside

(10) Patent No.: US 11,047,126 B1
(45) Date of Patent: Jun. 29, 2021

(54) ADJUSTABLE DRAIN ASSEMBLY AND RETROFIT KIT FOR ADJUSTABLE DRAIN ASSEMBLY

(71) Applicant: MI-FAB Manufacturing, LLC, Chicago, IL (US)

(72) Inventor: Michael J. Whiteside, Chicago, IL (US)

(73) Assignee: MI-FAB Manufacturing LLC, Chicago, IL (US)

( * ) Notice: Subject to any disclaimer, the term of this patent is extended or adjusted under 35 U.S.C. 154(b) by 0 days.

(21) Appl. No.: 16/715,780

(22) Filed: Dec. 16, 2019

(51) Int. Cl.
*E03F 5/04* (2006.01)
*E03C 1/22* (2006.01)

(52) U.S. Cl.
CPC ..... *E03F 5/0407* (2013.01); *E03C 1/22* (2013.01); *E03F 5/041* (2013.01); *E03F 2005/0413* (2013.01); *E03F 2005/0415* (2013.01)

(58) Field of Classification Search
CPC ..... E03F 5/04; E03F 5/0407; E03F 5/0408; E03F 5/041; E03F 2005/0413; E03F 2005/0414; E03C 1/20; E03C 1/22
USPC ..... 210/163, 164; 4/679; 52/302.1
See application file for complete search history.

(56) References Cited

U.S. PATENT DOCUMENTS 2,490,075 A * 12/1949 Matheis ..... E03F 5/0407 210/165
3,030,710 A 4/1962 Fell
3,246,582 A * 4/1966 James ..... E03F 5/0407 210/164
3,752,032 A 8/1973 Fiddler
4,606,688 A 8/1986 Moran et al.
4,883,590 A 11/1989 Papp
6,042,314 A 3/2000 Volker
6,269,495 B1 8/2001 Sondrup
6,766,545 B2 7/2004 Hodges
7,964,095 B1 6/2011 GrayBeal
7,997,038 B2 8/2011 Warnecke et al.
8,196,229 B1 6/2012 Hickok
8,347,906 B1 1/2013 Ismert et al.
8,881,490 B2 11/2014 Wroblewski et al.
9,290,925 B2 3/2016 Majocka et al.
9,422,707 B2 8/2016 Hull
9,453,331 B1 9/2016 Buffington
2006/0242913 A1 11/2006 Zhou
2011/0296606 A1 12/2011 Wedi
2014/0020174 A1 1/2014 Evans et al.
2016/0032578 A1* 2/2016 Toms ..... E03F 5/0407 4/613
2017/0247872 A1 8/2017 Huber
2019/0119896 A1 4/2019 Priester
2020/0157790 A1* 5/2020 English ..... E03C 1/22

FOREIGN PATENT DOCUMENTS

WO 2019171179 9/2019

* cited by examiner

*Primary Examiner* — Christopher Upton
(74) *Attorney, Agent, or Firm* — Phillips Lytle LLP; David L. Principe

(57) ABSTRACT

An adjustable drain assembly for adjusting the level and pitch of the frame so that, after installation, the frame can be adjust so that the strainer is level or flush with the finished floor surface. A retrofit kit for combining with a preexisting head already installed in a floor to provide an adjustable drain assembly is also disclosed.

20 Claims, 11 Drawing Sheets

ADJUSTABLE DRAIN ASSEMBLY AND RETROFIT KIT FOR ADJUSTABLE DRAIN ASSEMBLY

BACKGROUND OF THE INVENTION

1. Field of the Invention

The present invention relates to floor drains generally and, more particularly, to floor drains having a leveling mechanism.

2. Description of Related Art

A floor drain is used to funnel liquids from a floor surface into a drain pipe. The floor drain typically has a grate or strainer attached to the top drain to allow liquid to flow through the drain, but prevent larger solid objects from entering the floor drain. A particular type of floor drain known as an adjustable floor drain, as shown in FIGS. 1 and 2, employs a strainer 10, a head 20, a membrane clamp collar 30, and a lower body 40. The head 20 has a long threaded shank 22 that allows the head 20 to be adjusted upwardly and downwardly via a mating thread 32 in the membrane clamp collar 30. The head unit 20 is generally a one-piece component with the long threaded shank 22 extending upwardly and transitioning to a larger diameter flank portion 24 having a machined shoulder portion 26. The machined shoulder portion 26 of the head 20 receives the strainer 10, which is typically secured to the head 20 using machine screws. The clamp collar 30 is secured to the lower body 40 via machine screws 43. The lower body 40 defines a passageway 44 therethrough for receiving a drain pipe 46.

Referring to FIG. 2, a problem develops during the installation of these types of drains due to variances associated with the finished floor height and pitch. During installation, the lower body 40, clamp collar 30, and head 20 are positioned, supported, and leveled. The head 20 is screwed up or down to adjust to a desired height using the threaded shank 22 and mating thread 32. Concrete 50 is poured to encase the entire assembly just below or up to the top level of the head 20 and a finished floor surface 55, such as ceramic or quarry tile, is laid on the top of the concrete 50. A problem can occur at this time if the head unit 20 of the drain assembly was incorrectly adjusted to compensate for the total thickness of the finished floor surface 55, e.g., the tile and thin set mortar. If the top surface of the head 20 is too low, then the strainer 10 will not be flush with the finished floor surface 55. Further, if the pitch of the concrete 50 and the finished floor surface 55 is not level with the top surface of the head 20, the strainer 10 will not be level or flush with the finished floor surface 55.

SUMMARY OF THE INVENTION

With parenthetical reference to the corresponding parts, portions or surfaces of the disclosed embodiment, merely for purposes of illustration and not by way of limitation, the present invention broadly provides in a first embodiment a structure positioned adjacent to a floor surface for connecting to a drain pipe (278). The structure includes a head (123) having an opening (124) leading to an inside surface (138) defining a passageway. The inside surface (138) has a tab (135) extending therefrom. The tab (135) is disposed below and in spaced apart relation to the opening (124). A leveling member (144) has a head (153) with slots (154) defined therein for turning the leveling member (144). The leveling member (144) is supported by the tab (135) and is configured and arranged to be displaceable in a first direction relative to the tab (135). A frame (175) has an upper surface and a lower surface. The frame (175) has a bracket (187) that is angled downward and inward from the lower surface. The bracket (187) has a distal portion configured and arranged to attach the frame (175) to the leveling member (144) at a position below the head (153) of the leveling member (144).

In another aspect of the invention, the leveling member (144) further comprises the head (153) having a first diameter, a shank (156) having a first portion (159) and a second portion (165). The second portion (165) has a diameter greater than the first portion (159) such that a groove (172) is formed between the second portion (165) and the head (153).

The groove (172) is configured and arranged to engage with the distal portion of the bracket (187) on the frame (175).

In another aspect, the structure further comprises a strainer (184) that is positioned adjacent the top surface of the frame (175).

In another aspect, the strainer (184) has an access opening (196) defined therein. At least a portion of the leveling member (144) is aligned with the access opening (196).

In another aspect, the frame (175) is substantially ring-shaped and further comprises a rim (181) surrounding the top surface. The rim (181) forms a shoulder for receiving the strainer (184).

In another aspect, the head (153) has a threaded shank (132) and a flange portion extending outwardly from the shank.

In another aspect, the structure further comprises a collar (260) having an internal surface having internal threads (262) configured and arranged to engage with the threaded shank (132) on the head (123). The head (153) threadingly engages with the collar (260) and is capable of displacement relative to the collar (260).

In another aspect the structure further comprises a lower body (270) configured and arranged to receive the collar (260). The lower body (270) defines a passageway therethrough.

In another aspect, the structure further comprises a drain pipe (278) secured to the lower body (270).

In another embodiment, a drain assembly (200) is provided with a head (123) having a threaded shank (132) and having an opening (124) leading to an inside surface (138) defining a passageway. The inside surface (138) has a tab (135) extending therefrom. The tab (135) is disposed below and in spaced apart relation to the opening (124). A leveling member (144) has a head (153) with slots (154) defined therein for turning the leveling member (144). The leveling member (144) is supported by the tab (135) and is configured and arranged to be displaceable in a first direction relative to the tab (135).

A frame (175) has an upper surface and a lower surface. The frame (175) has a bracket (187) angled downward and inward from the lower surface. The bracket (187) has a distal portion configured and arranged to attach the frame (175) to the leveling member (144) at a position below the head (153) of the leveling member (144). A collar (260) having an internal surface having internal threads (262) is configured and arranged to engage with the threaded shank (132) on the head (123) such that the head (123) threadingly engages with the collar (160) and is capable of displacement relative to the collar (160). A lower body (270) is configured and arranged to receive the collar (260). The lower body (270) defines a passageway there through. A drain pipe (278) is secured to the lower body (270).

In another aspect, the leveling member (144) has a head (153) with a first diameter (168), and a shank (156) having a first portion (159) and a second portion (165). The second portion (165) has a diameter (168) greater than the diameter (162) of the first portion (159) such that a groove (172) is formed between the second portion (165) and the head (153). The groove (172) is configured and arranged to engage with the distal portion of the bracket (187) on the frame (175).

In another aspect, the drain assembly includes a strainer (184) positioned adjacent the top surface of the frame (175).

In another aspect, the strainer (184) has an access opening (196) defined therein. A portion of the leveling member (144) is aligned with the access opening (196).

In another aspect, the frame (175) is substantially ring-shaped and further comprises a rim (181) surrounding the top surface. The rim (181) forms a shoulder for receiving the strainer (184).

In another embodiment, a retrofit kit (300) is disclosed for use with a head (310) positioned adjacent to a floor surface for connecting to a drain pipe (478). The kit (300) includes a base ring (303) having an opening (304) defined therein. The base ring (303) is configured and arranged to attach to the head (310). The base ring (303) has an upper surface and a lower surface. A tab (335) is supported below the lower surface of the base ring (303). The tab (335) is disposed below and in spaced apart relation to the opening (304). A leveling member (344) having a head (353) with slots (354) defined therein for turning the leveling member (344). The leveling member (344) is supported by the tab (335) and is configured and arranged to be displaceable in a first direction relative to the tab (335). A frame (375) has an upper surface and a lower surface. The frame (375) has a bracket (387) angled downward and inward from the lower surface. The bracket (387) has a distal portion configured and arranged to attach the frame (375) to the leveling member (344) at a position below and spaced apart from the head (353) of the leveling member (344).

In another aspect, the leveling member (344) has a head (353) having a first diameter, and has a shank (359) having a first portion (359) and a second portion (365). The second portion (365) has a diameter greater than the first portion (359) such that a groove (372) is formed between the second portion (365) and the head (353). The groove (372) is configured and arranged to engage with the distal portion of the bracket (387) on the frame (375).

In another aspect, the drain assembly further comprises a strainer (384) positioned adjacent the top surface of the frame (375).

In another aspect, the kit includes a strainer (384) having an access opening (396) defined therein. At least a portion of the leveling member (344) is aligned with the access opening (396).

In another aspect, the kit includes a frame (375) that is substantially ring-shaped and further comprises a rim (381) surrounding the top surface, the rim (381) forming a shoulder for receiving the strainer (384).

DETAILED DESCRIPTION OF THE INVENTION

Figure 1:
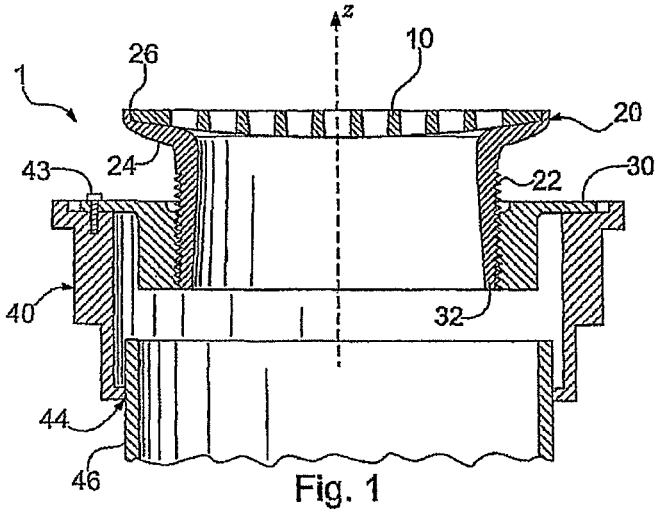
Fig. 1 (PRIOR ART)
FIG. 1 is a cross-sectional view of a prior art floor drain assembly.
Figure 2:
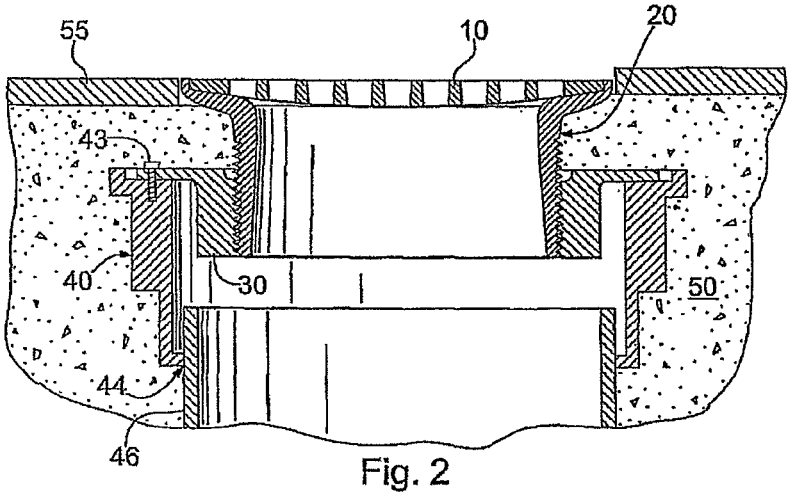
Fig. 2 (PRIOR ART)
FIG. 2 is a cross-sectional view of the prior art floor drain assembly of FIG. 1, showing the floor drain assembly in an installed position.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, debris, etc.) together with the specification, and are to be considered a portion of the entire written description of this invention. As used in the following description, the terms "horizontal", "vertical", "left", "right", "up" and "down", as well as adjectival and adverbial derivatives thereof, (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or of rotation, as appropriate.

Figure 3:
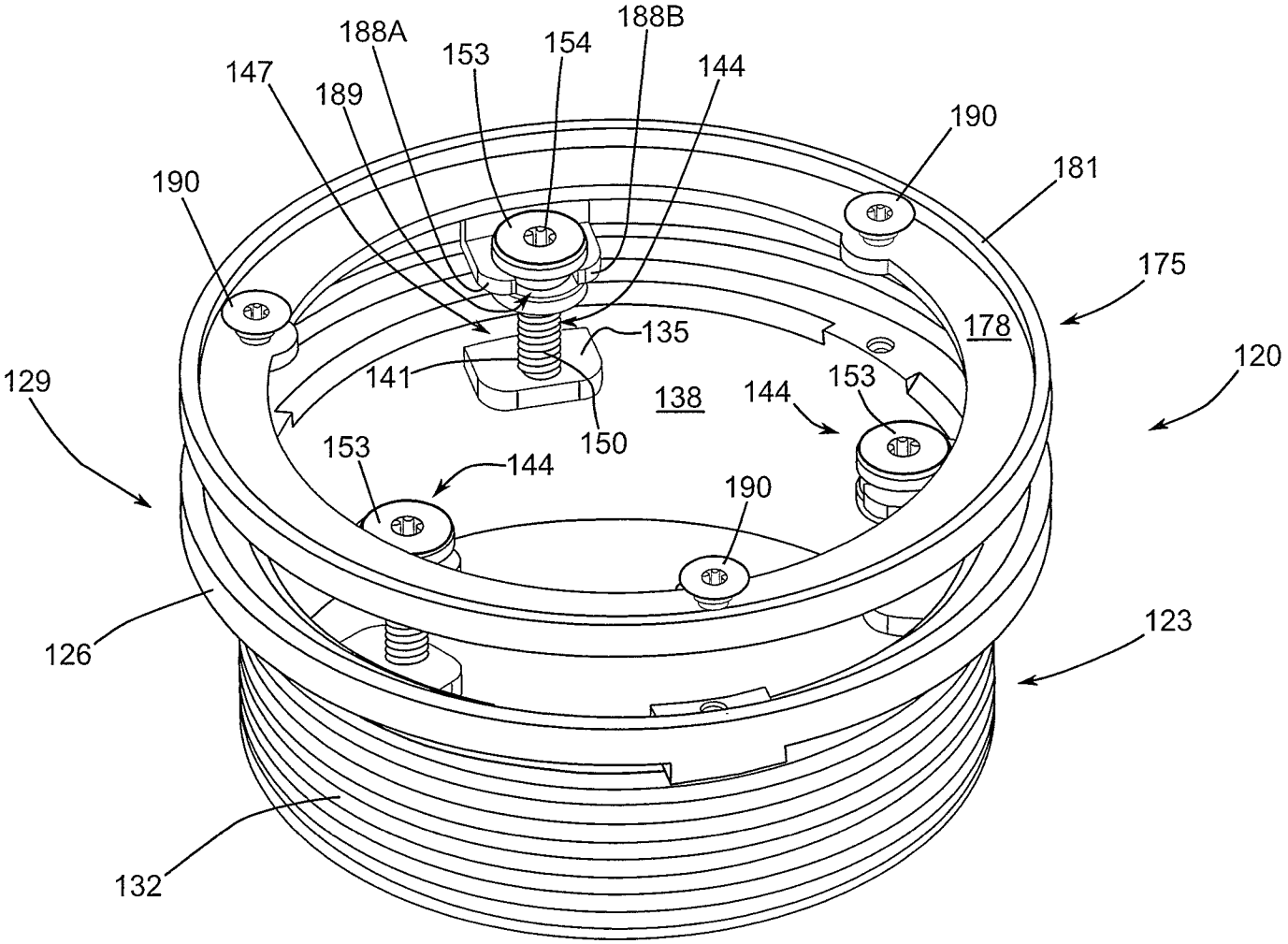
FIG. 3 is a perspective view of an adjustable floor drain assembly according to one embodiment of the present invention.
Figure 4:
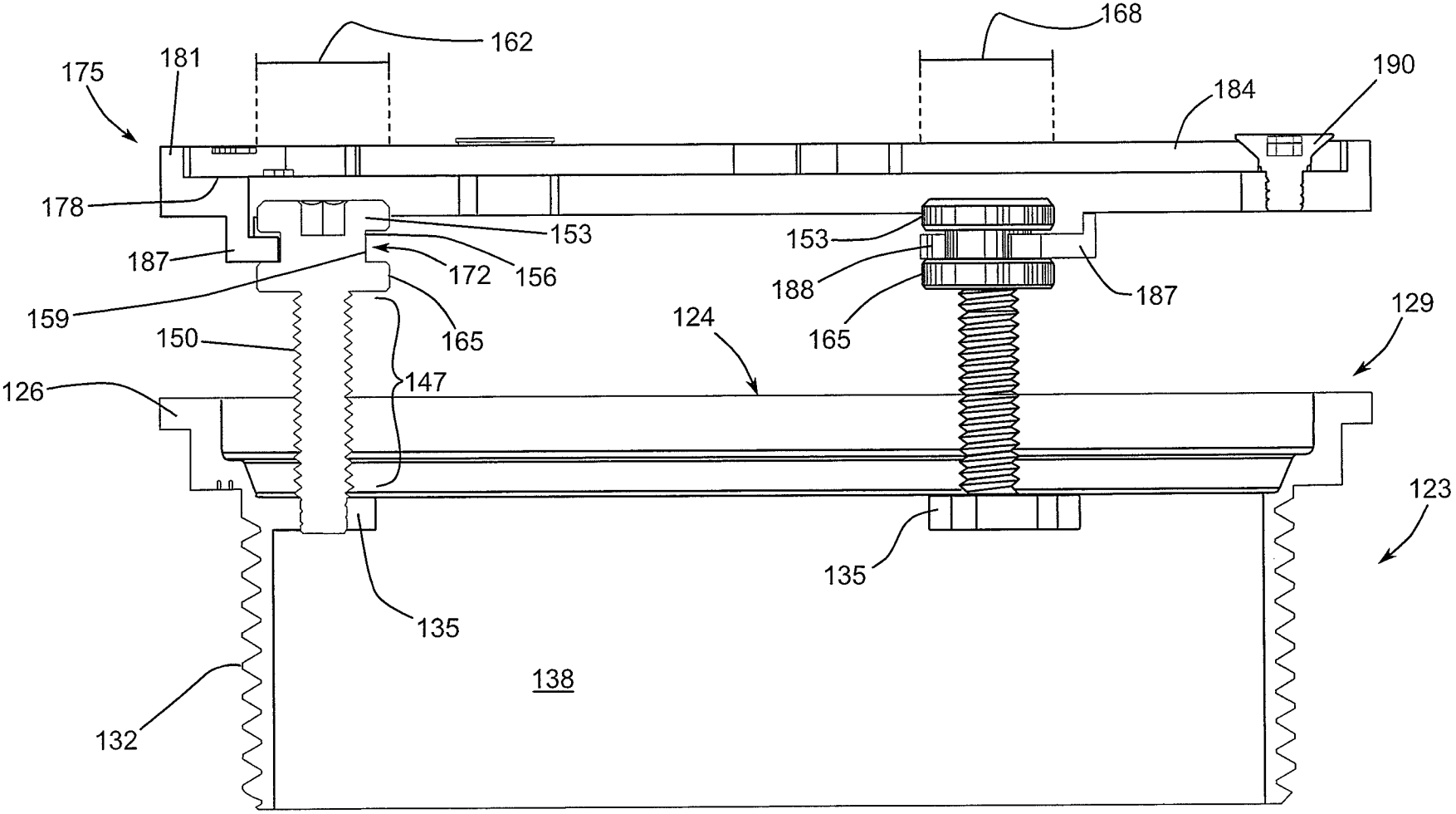
FIG. 4 is a front elevational view, partially in cross section, of the embodiment shown in FIG. 3.

According to one embodiment, shown generally in FIGS. 3-7, and initially referring to FIG. 3, an adjustable floor drain assembly 120 includes a head 123 having a flange 126 at a first end 129 of the head 123. The head 123 has an opening 124 (FIG. 4) leading to a passageway for draining fluids. The head 123 also includes a set of external threads 132. A plurality of tabs 135 extend from an inside surface 138 of the head 123. The tabs 135 may be provided with a threaded opening 141 that receives a leveling member 144 which may comprise a screw with threads. The leveling member 144 has a first portion 147 containing a set of external threads 150. The leveling member 144 also includes a head 153 with slots 154 for a turning tool to fit into. Turning to FIG. 4, the leveling member 144 includes a shank 156 with a first portion 159 having a first diameter 162. The shank 156 also includes a second portion 165 with a second diameter 168 that is greater than the first diameter 162. The second diameter 168 may be approximately equal to the diameter 162 of the head 153. The first portion 159 is disposed between the head 153 and the second portion 165. The change in diameter between the head 153 and the second portion 165 along the length of the leveling screw 144 provides a groove 172.

Figure 5:
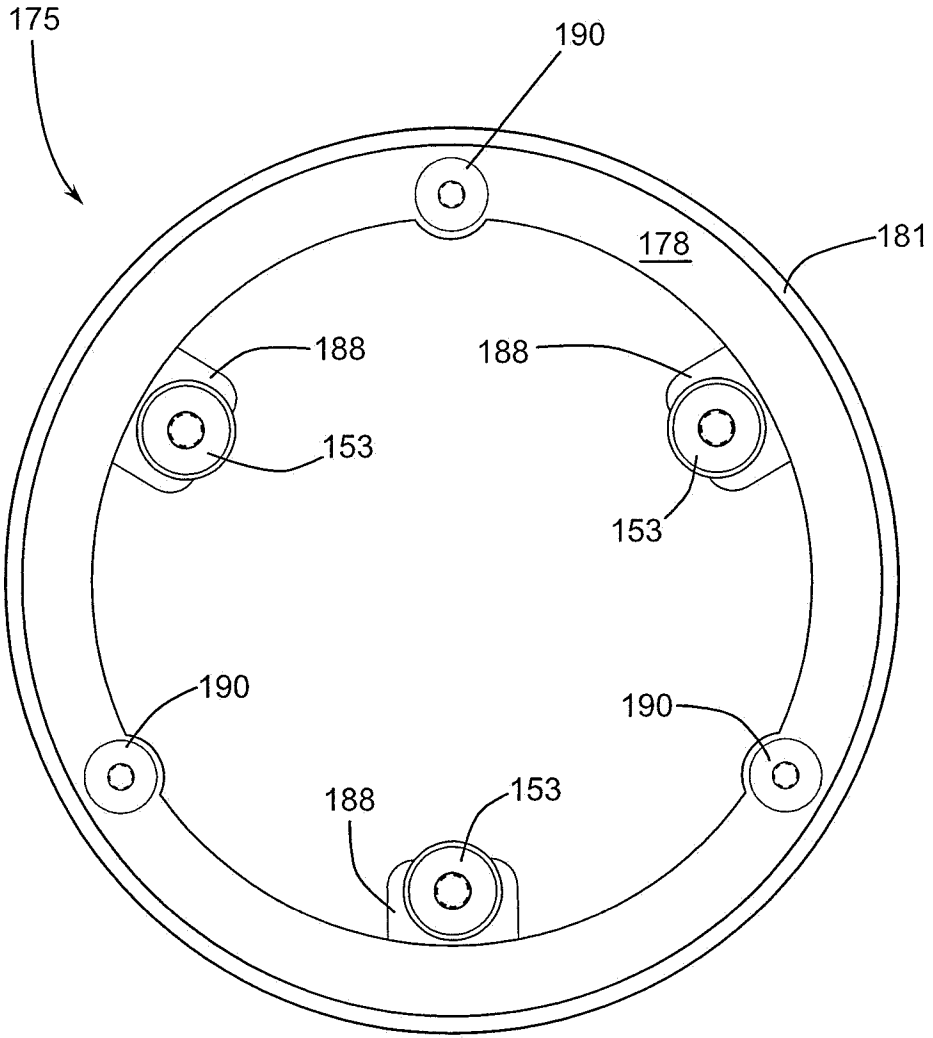
FIG. 5 is top plan view of the embodiment shown in FIG. 3.

As best shown in FIG. 5, a frame 175 has a support surface 178 that is bordered by a rim 181. The support surface 178 receives a strainer 184 (shown in FIGS. 4 and 6). The strainer 184 may be circular with a plurality of openings and a plurality of flow passages defined therein. The flow passages permit the flow of fluid there through, but prevent the passage of solids of a particular size.

Returning to FIG. 4, an L-shaped bracket member 187 may extend from the bottom of the frame 175. The L-shaped bracket member 187 has a distal portion 188 that engages with the leveling member 144 inside the groove 172. As shown in FIG. 3, the distal portion 188 may include an opening 189 defined by a pair of opposed members 188A and 188B. Accordingly, each leveling member 144 is operatively associated with the frame 175 such that raising and lowering the leveling member 144 results in raising and lowering the portion of the frame 175 at or near the leveling member 144.

As shown in FIG. 5, a set of fasteners 190 may be provided for attaching the strainer 184 to the frame 175.

Figure 6:
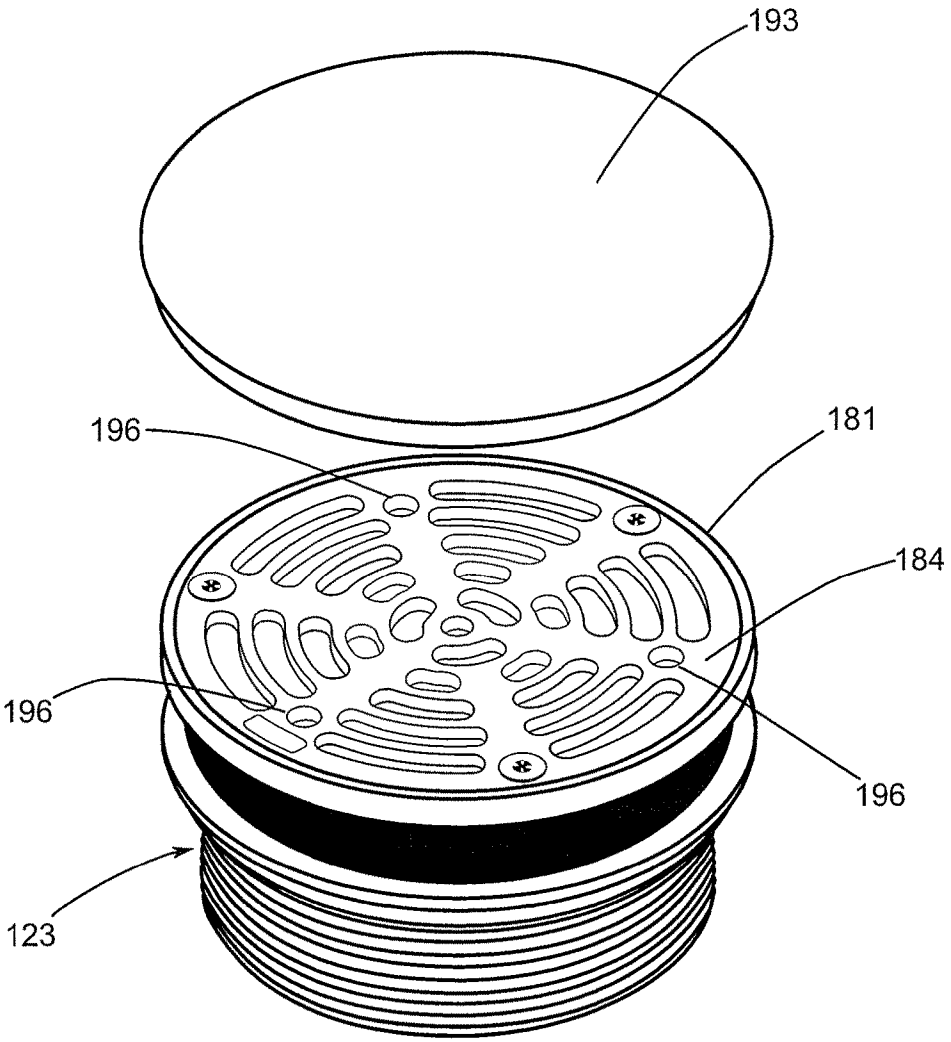
FIG. 6 is an exploded perspective view of the embodiment shown in FIG. 3 with a cover.
Figure 7:
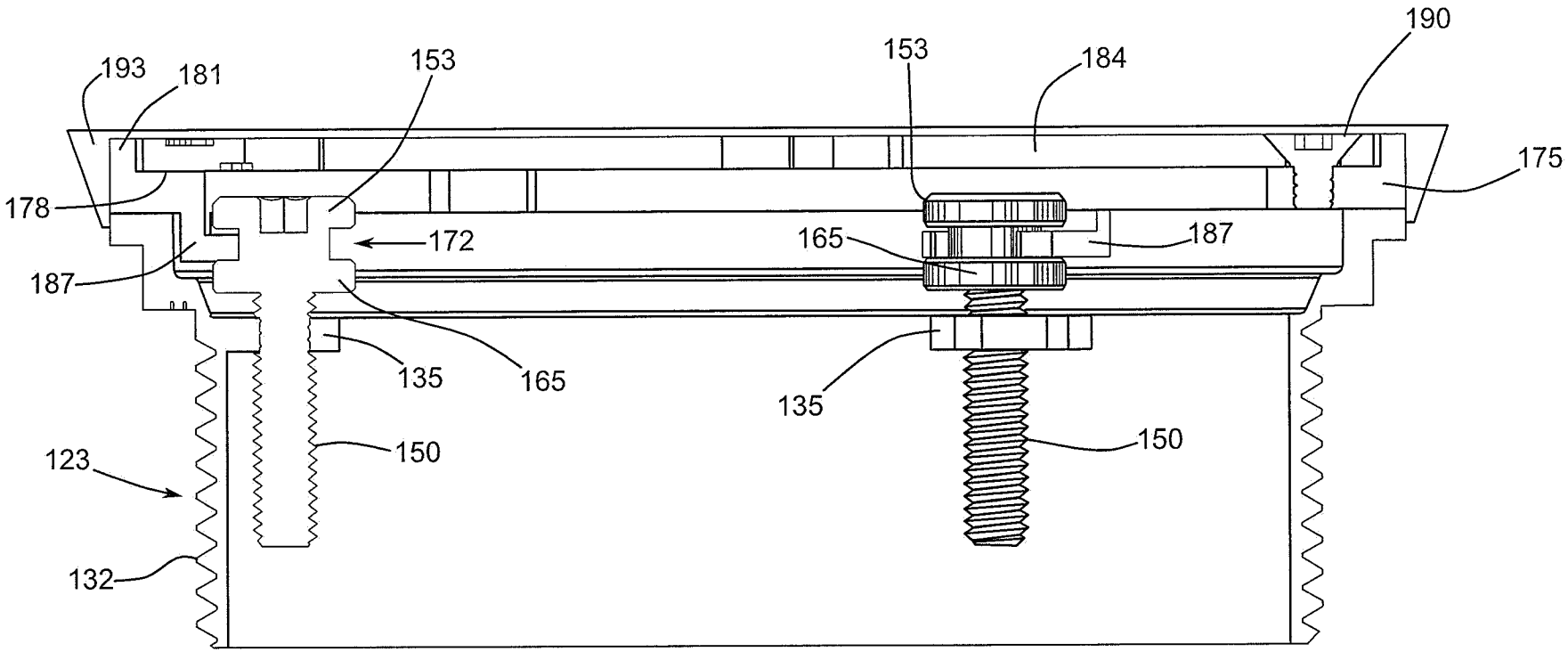
FIG. 7 is a front elevational view, partially in cross section, of the embodiment shown in FIG. 6.

Turning to FIGS. 6 and 7, during installation and specifically the pouring of concrete, a cover 193 may be attached over the frame 175 at the top of the adjustable floor drain assembly 120. The strainer 184 may be provided with a plurality of openings 196. The openings 196 provide access for a turning tool to be inserted into the head 153 of the leveling member 144. As a result, after the concrete is poured and the final floor surface is installed, the height and angle of the upper surface of the strainer 184 may be adjusted to be level or flush with the finished floor surface by adjusting the position of the frame 175 via the leveling members 144.

Figure 8:
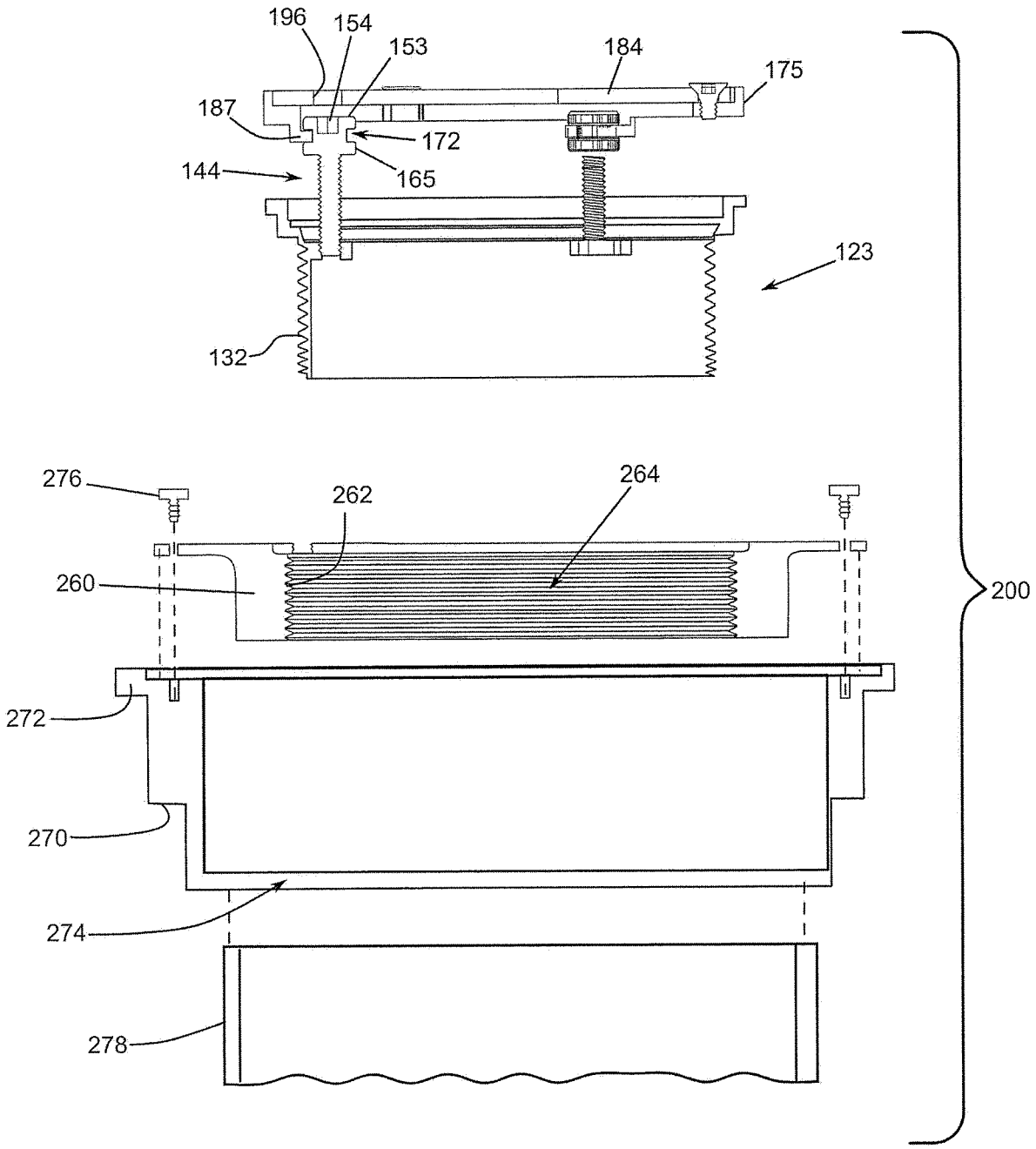
FIG. 8 is an exploded cross-sectional view of the embodiment shown in FIG. 3 being used in a drain system.
Figure 9:
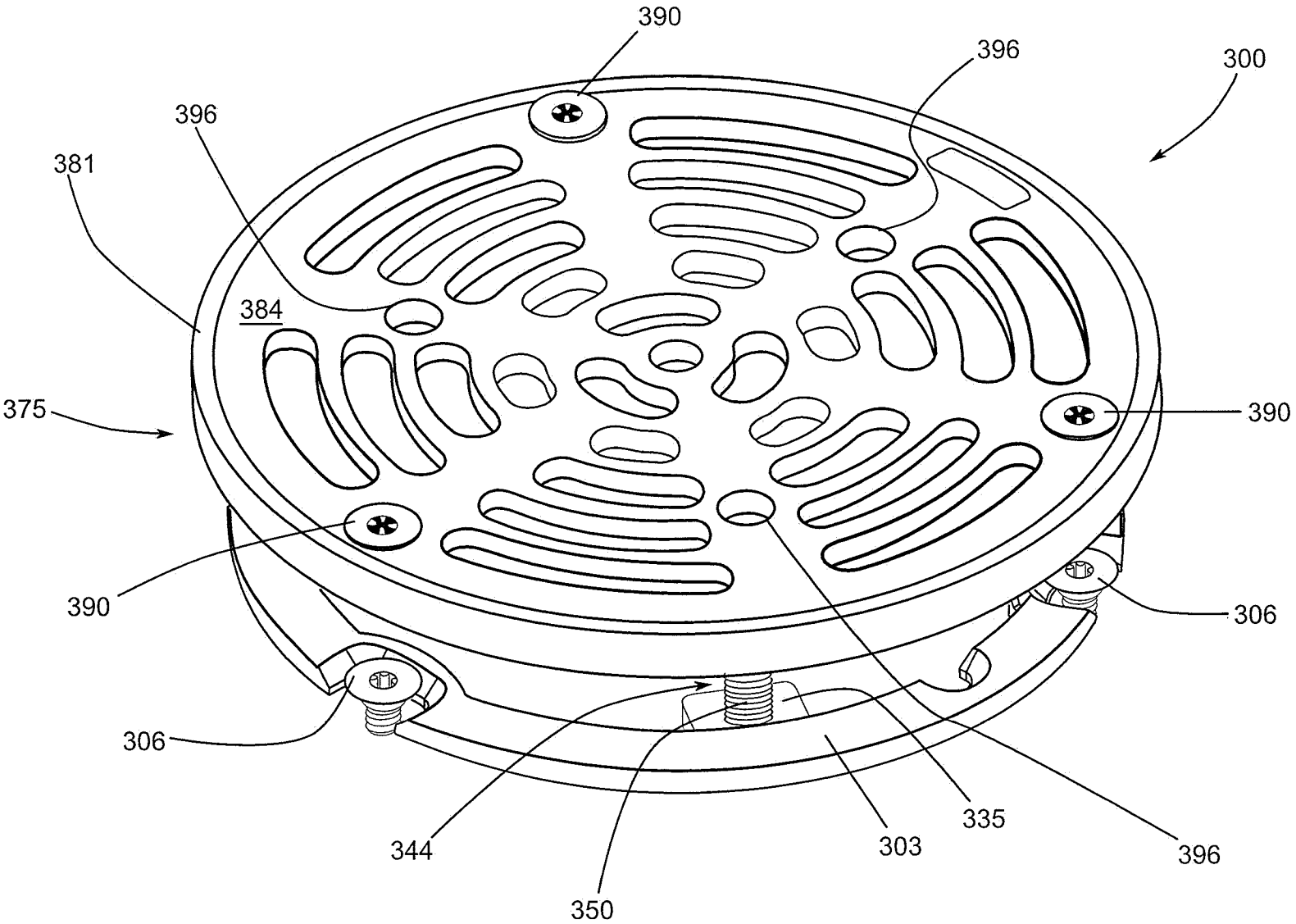
FIG. 9 is a perspective view of one embodiment of a retrofit kit according to the present invention.
Figure 10:
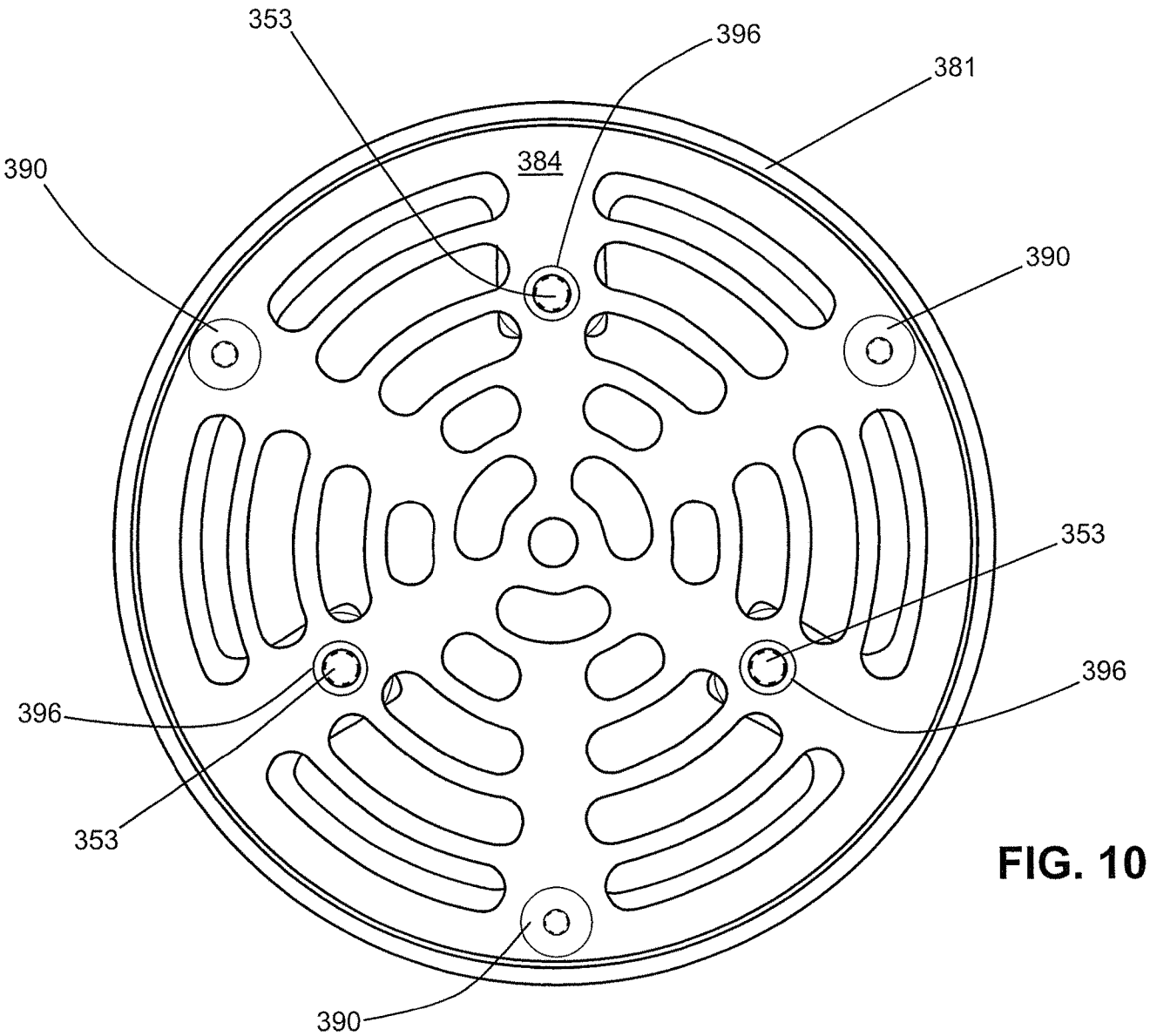
FIG. 10 is a top plan view of the embodiment shown in FIG. 9.

Referring to FIG. 8, upon assembly of the floor drain system 200, the threaded shank 132 of the head 123 is secured to a mating thread 262 of the collar 260 allowing for upward and downward adjustment of the head 123. The collar 260 defines a passageway 264 therethrough and is secured to a flange portion 272 of the lower body 270 via screws 276. The lower body 270 defines a passageway 274 therethrough for receiving a drain pipe 278. The drain pipe 278 may be secured to the lower body 270 via a friction fit with chalking, e.g., oakum and lead, provided between the inside of the lower body 270 and the outside of the drain pipe 278. Any other suitable arrangements for securing the drain pipe 278 to the lower body 270 may also be provided.

After the head 123 is secured to the collar 260 and the head 123 is adjusted to a sufficient height, concrete is poured to encase the floor drain system 200 just below or up to the top surface of the head unit 123 and a finished floor surface, such as ceramic or quarry tile, is laid on the top of the cured concrete.

In certain installations of the floor drain system 200, the concrete and finished floor surface are not level with the top surface of the frame 175 such that the strainer 184 will not be flush with the finished floor surface. In order to adjust the pitch of the frame 175 and strainer 184, a turning tool is inserted through opening 196 and the turning tool is engaged with the slots 154 in the head 153 of the leveling member 144 to raise and lower the leveling member. The raising and lowering of the leveling member 144 provides for adjusting the height and slope of the strainer 84.

Figure 11:
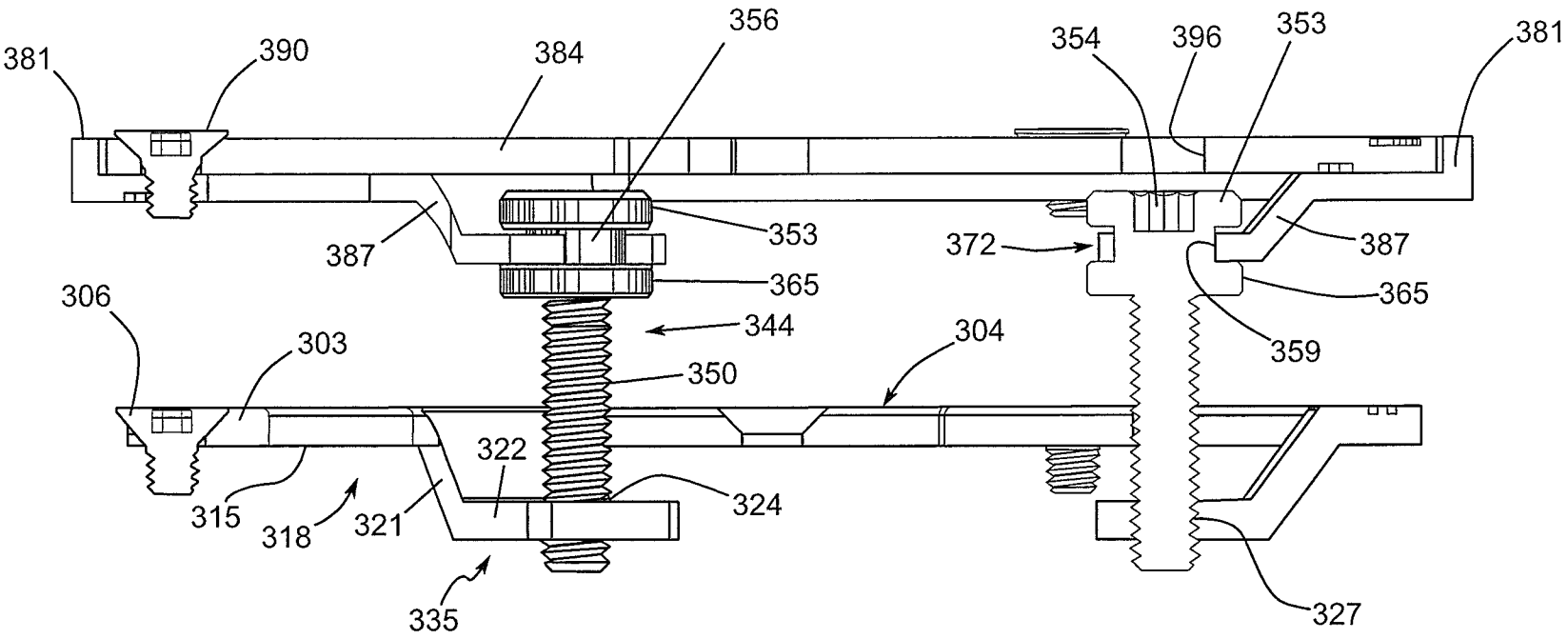
FIG. 11 is a front elevational view of the embodiment shown in FIG. 9; and, FIG. 12 is an exploded cross-sectional view of the embodiment shown in FIG. 9 being used in a drain system.

Turning to FIGS. 9-12, a retrofit kit 300 for an adjustable drain assembly provides a base ring 303 that may be attached to a preexisting head 310 (shown in FIG. 12) by fasteners 306. The base ring 303 includes a tab portion 335 that is supported from a bottom surface 315 of the base ring 303 as shown in FIG. 11. A frame 375 may be adjusted by means of engagement between leveling members 344 with tab portions 335 on the base ring 303.

Once the leveling members 344, which carry the frame 375, are engaged with the threaded surfaces inside the tab portions 335, the height and angle of the upper surface of the strainer 384 can be adjusted by inserting a turning tool through openings 396 in the strainer 384. The turning tool (not shown) is inserted through opening 396 and is engaged with slots 354 in the head 353 in order to turn the leveling screw 344. Raising and lowering an individual leveling member 344 adjusts the height and angle of the portion of the strainer 384 near the leveling member 344. The strainer 384 may be attached to the frame by means of fasteners 390. The strainer 384 fits inside the frame 375 and is supported by a support surface 378 bordered by a rim 381. The top of the strainer 384 may be flush with the top of the rim 381.

Turning to FIG. 11, the tab portion 335 on the base ring 303 may be formed by an elongate member 318 having a first portion 321 angled downward and inward and a horizontal portion 322 having an opening 324 bordered by a threaded inner wall 327. The base ring 303 is attached to the preexisting head 310 by fasteners 306.

As shown the leveling members 344 may be formed in the same manner as described above in connection with leveling members 44. The frame 375 may engage with a groove 372 formed in the leveling members 344. The frame 375 may be provided with an L-shaped bracket member 387 having a distal portion configured to attach around the first portion 359 of the shank 356 in the groove 372. The frame 375 has a support surface 378 bordered by a rim 381. The strainer 384 may be attached to the frame 375 by means of fasteners 390.

Figure 12:
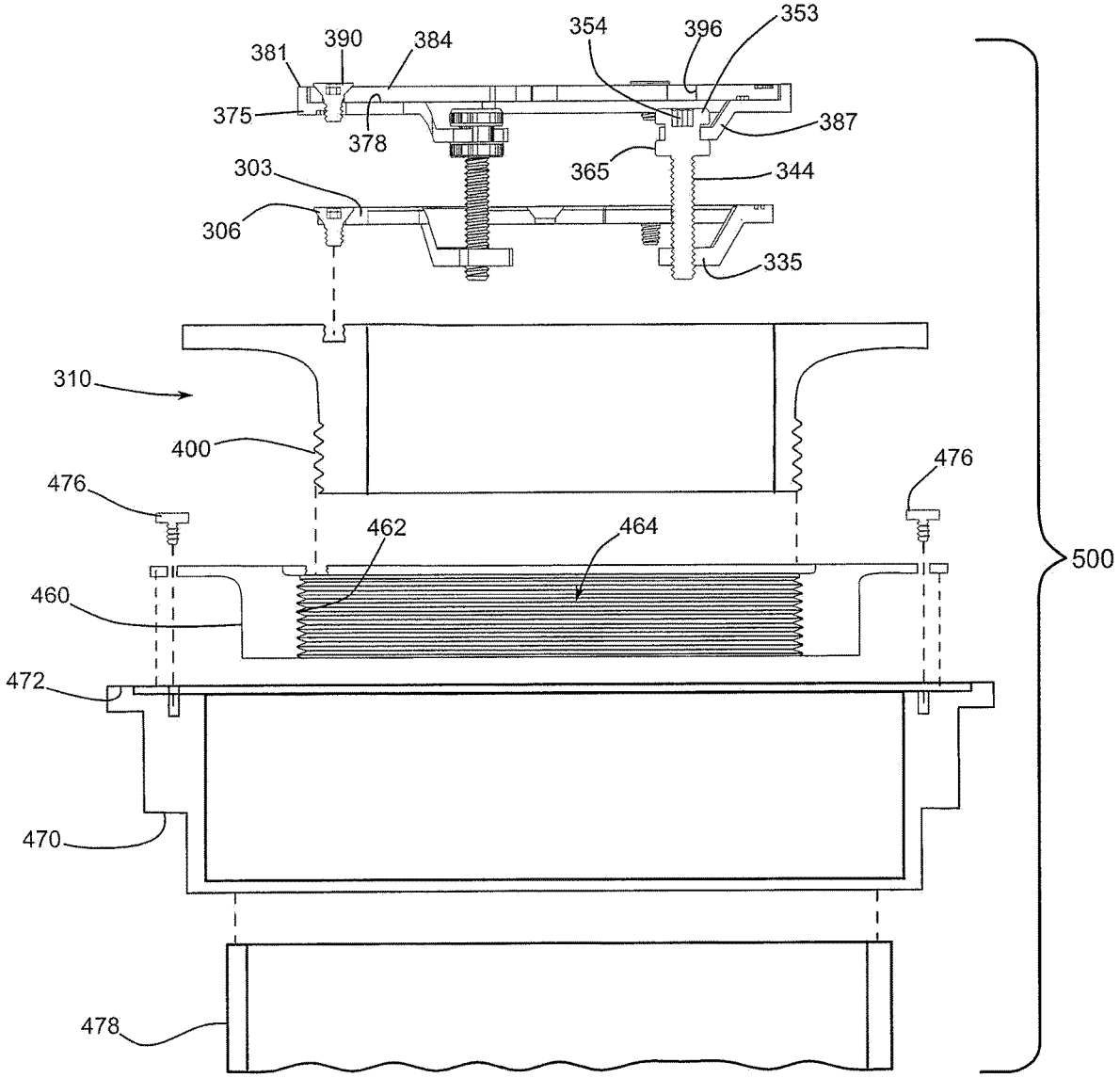

In FIG. 12, upon assembly of the retrofit kit 300 as part of a drain system 500, a threaded shank 400 on the head 310 secures the head 310 to a mating thread 462 of the collar 460 allowing for upward and downward adjustment of the head 310. The collar 460 defines a passageway 464 therethrough and is secured to a flange portion 472 of the lower body 470 via screws 476. The lower body 470 defines a passageway 474 therethrough for receiving a drain pipe 478. The drain pipe 478 may be secured to the lower body 470 via a friction fit with chalking, e.g., oakum and lead, provided between the inside of the lower body 470 and the outside of the drain pipe 478. Any other suitable arrangements for securing the drain pipe 478 to the lower body 470 may also be provided.

After the head 310 is secured to the collar 460 and the head 310 is adjusted to a sufficient height, concrete is poured to encase the floor drain system 500 just below or up to the top surface of the head unit 310 and a finished floor surface, such as ceramic or quarry tile, is laid on the top of the cured concrete.

In certain installations of the floor drain, the concrete and finished floor surface are not level with the top surface of the frame 375 such that the strainer 384 will not be flush with the finished floor surface. In order to adjust the pitch of the frame 375 and strainer 384, a turning tool is inserted through opening 396 and the turning tool is engaged with the slots 354 in the head 353 of the leveling member 344 to raise and lower the leveling member 344. The raising and lowering of the leveling member 344 provides for adjusting the height and slope of the strainer 384.

While certain embodiments of the adjustable floor drain assembly and retrofit kit for a floor drain assembly were described in the foregoing detailed description, those skilled in the art may make modifications and alterations to these embodiments without departing from the scope and spirit of the invention. Accordingly, the foregoing description is intended to be illustrative rather than restrictive.

What is claimed is:

1. A structure positioned adjacent to a floor surface for connecting to a drain pipe, the structure comprising:

a head having an opening leading to an inside surface defining a passageway, the inside surface having a tab extending therefrom, the tab disposed below and in spaced apart relation to the opening;

a leveling member having a head with a with slots defined therein for turning the leveling member, the leveling member supported by the tab and configured and arranged to be displaceable in a first direction relative to the tab;

a frame having an upper surface and a lower surface, the frame having a bracket extending downward and inward from the lower surface, the bracket having a distal portion configured and arranged to attach the frame to the leveling member at a position below the head of the leveling member.

2. The structure of claim 1, wherein the leveling member further comprises the head having a first diameter, a shank having a first portion and a second portion, the second portion having a diameter greater than the first portion such that a groove is formed between the second portion and the head, the groove configured and arranged to engage with the distal portion of the bracket on the frame.

3. The structure of claim 1, further comprising a strainer positioned adjacent the top surface of the frame.

4. The structure of claim 3, wherein the strainer has an access opening defined therein, at least a portion of the leveling member being aligned with the access opening.

5. The structure of claim 3, wherein the frame is substantially ring-shaped and further comprises a rim surrounding the top surface, the rim forming a shoulder for receiving the strainer.

6. The structure of claim 1, wherein the head has a threaded shank and a flange portion extending outwardly from the shank.

7. The structure of claim 6, further comprising a collar having an internal surface having internal threads configured and arranged to engage with the threaded shank on the head such that the head threadingly engages with the collar and is capable of displacement relative to the collar.

8. The structure of claim 7, further comprising a lower body configured and arranged to receive the collar, the lower body defining a passageway therethrough.

9. The structure of claim 8 further comprising a drain pipe secured to the lower body.

10. The structure of claim 1, further comprising a cover configured and arranged to removably attach to the frame during installation.

11. A drain assembly, comprising:

a head having a threaded shank and having an upstream opening leading to an inside surface defining a passageway, the inside surface having a tab extending therefrom, the tab disposed below and in spaced apart relation to the upstream opening;

a leveling member having a head with a with slots defined therein for turning the leveling member, the leveling member supported by the tab and configured and arranged to be displaceable in a first direction relative to the tab;

a frame having an upper surface and a lower surface, the frame having a bracket angled downward and inward from the lower surface, the bracket having a distal portion configured and arranged to attach the frame to the leveling member at a position below the head of the leveling member;

a collar having an internal surface having internal threads configured and arranged to engage with the threaded shank on the head such that the head threadingly engages with the collar and is capable of displacement relative to the collar;

a lower body configured and arranged to receive the collar, the lower body defining a passageway therethrough; and, a drain pipe secured to the lower body.

12. The drain assembly of claim 11, wherein the leveling member further comprises the head having a first diameter, a shank having a first portion and a second portion, the second portion having a diameter greater than the first portion such that a groove is formed between the second portion and the head, the groove configured and arranged to engage with the distal portion of the bracket on the frame.

13. The drain assembly of claim 11, further comprising a strainer positioned adjacent the top surface of the frame.

14. The drain assembly of claim 13, wherein the strainer has an access opening defined therein, at least a portion of the leveling member being aligned with the access opening.

15. The drain assembly of claim 11, wherein the frame is substantially ring-shaped and further comprises a rim surrounding the top surface, the rim forming a shoulder for receiving the strainer.

16. A retrofit kit for use with a head positioned adjacent to a floor surface for connecting to a drain pipe, the kit comprising:

a base ring having an opening defined therein, the base ring configured and arranged to attach to the head, the base ring having an upper surface and a lower surface, a tab supported below the lower surface of the base ring, the tab disposed below and in spaced apart relation to the opening;

a leveling member having a head with a with slots defined therein for turning the leveling member, the leveling member supported by the tab and configured and arranged to be displaceable in a first direction relative to the tab;

a frame having an upper surface and a lower surface, the frame having a bracket angled downward and inward from the lower surface, the bracket having a distal portion configured and arranged to attach the frame to the leveling member at a position below the head of the leveling member.

17. The kit of claim 16, wherein the leveling member further comprises the head having a first diameter, a shank having a first portion and a second portion, the second portion having a diameter greater than the first portion such that a groove is formed between the second portion and the head, the groove configured and arranged to engage with the distal portion of the bracket on the frame.

18. The kit of claim 16, further comprising a strainer positioned adjacent the top surface of the frame.

19. The kit of claim 18, wherein the strainer has an access opening defined therein, at least a portion of the leveling member being aligned with the access opening.

20. The kit of claim 18, wherein the frame is substantially ring-shaped and further comprises a rim surrounding the top surface, the rim forming a shoulder for receiving the strainer.

* * * * *